US010455343B2

(12) United States Patent
Skubinski, III et al.

(10) Patent No.: US 10,455,343 B2
(45) Date of Patent: Oct. 22, 2019

(54) SINGLE MAGNET PLANAR-MAGNETIC TRANSDUCER

(71) Applicant: JPS LABS LLC, East Aurora, NY (US)

(72) Inventors: Joseph P. Skubinski, III, Lancaster, NY (US); Eric E. Skubinski, Depew, NY (US); Jason J. Skubinski, Lancaster, NY (US)

(73) Assignee: JPS LABS LLC, East Aurora, NY (US)

( * ) Notice: Subject to any disclaimer, the term of this patent is extended or adjusted under 35 U.S.C. 154(b) by 55 days.

(21) Appl. No.: 14/690,734

(22) Filed: Apr. 20, 2015

(65) Prior Publication Data

US 2015/0326974 A1 Nov. 12, 2015

Related U.S. Application Data

(60) Provisional application No. 61/990,381, filed on May 8, 2014.

(51) Int. Cl.

| | |
|---|---|
| ***H04R 7/04*** | (2006.01) |
| ***H04R 31/00*** | (2006.01) |
| ***H04R 5/033*** | (2006.01) |
| *H04R 1/28* | (2006.01) |

(52) U.S. Cl.

CPC ..... *H04R 31/00* (2013.01); *H04R 5/033* (2013.01); *H04R 7/04* (2013.01); *H04R 1/2869* (2013.01); *Y10T 29/49007* (2015.01)

(58) Field of Classification Search

CPC ..... H04R 7/04; H04R 31/00; H04R 5/033; H04R 1/2869; Y10T 29/49007

USPC ..... 381/309, 300, 370, 182, 371, 408, 431, 381/423, 424; 181/157, 163, 164; 29/594

See application file for complete search history.

(56) References Cited

U.S. PATENT DOCUMENTS 3,999,020 A * 12/1976 Bastiaans ..... H04R 1/1041 381/354
4,480,155 A * 10/1984 Winey ..... H04R 9/047 381/408
5,018,599 A * 5/1991 Dohi ..... H04R 1/1008 181/129
5,283,836 A * 2/1994 Trufitt ..... H04R 1/26 381/398
7,142,688 B2 11/2006 Croft, III et al.
8,520,887 B2 8/2013 Simidian, II et al.
(Continued)

*Primary Examiner* — Vivian C Chin
*Assistant Examiner* — Con P Tran
(74) *Attorney, Agent, or Firm* — RatnerPrestia

(57) ABSTRACT

Planar-magnetic transducers and headphone speakers are provided. The transducer includes a magnet, a diaphragm and an electrically conductive trace. The magnet is formed from a continuous piece of magnetic material. The magnet includes a first surface and a second surface opposite the first surface. The magnet includes at least one slot extending through the magnet from the first surface to the second surface. The diaphragm is mechanically coupled to a frame and disposed at a predetermined distance from the first surface of the magnet via the frame. The trace is coupled to the diaphragm. The trace is arranged in a predetermined pattern and at a predetermined position relative to the at least one slot of the magnet.

33 Claims, 6 Drawing Sheets

(56) References Cited

U.S. PATENT DOCUMENTS

| | | | | |
|---|---|---|---|---|
| 8,942,408 | B1 * | 1/2015 | Croft, III | H01F 7/0289 381/152 |
| 2002/0191808 | A1 * | 12/2002 | Croft, III | H04R 9/047 381/431 |
| 2003/0228029 | A1 * | 12/2003 | Graebener | H04R 9/047 381/432 |
| 2014/0270326 | A1 * | 9/2014 | Croft, III | H04R 9/025 381/398 |
| 2015/0110339 | A1 * | 4/2015 | Colich | H04R 3/00 381/424 |

* cited by examiner

Add exploded components view in 3D

SINGLE MAGNET PLANAR-MAGNETIC TRANSDUCER

CROSS-REFERENCE TO RELATED APPLICATIONS

This application claims priority to U.S. Patent Application No. 61/990,381, filed May 8, 2014, entitled "SINGLE MAGNET PLANAR-MAGNETIC TRANSDUCER," the contents of which are incorporated herein by reference in their entirety.

FIELD OF THE INVENTION

The present invention relates to electro-acoustic transducers and, more particularly, to planar-magnetic transducers and planar-magnetic headphone speakers having a one-piece magnet with at least one slot.

BACKGROUND OF THE INVENTION

Loudspeakers (also referred to herein as speakers) are a type of electroacoustic transducer that convert electrical energy to acoustic energy. One common type of loudspeaker includes dynamic speakers. Dynamic speakers use a magnetic field to move a diaphragm and produce sound waves. Another type of loudspeaker includes electrostatic speakers, that use a high voltage electric field to drive a thin statically charged membrane (acting as a diaphragm). A further type of loudspeaker includes planar-magnetic speakers, that include a thin flexible membrane (acting as a diaphragm) having a voice coil mounted thereon. Current flowing through the voice coil interacts with a magnetic field produced by magnets placed on either side of the membrane, causing the membrane to vibrate. Planar-magnetic speakers typically include rectangular flat surfaces that radiate in a bipolar manner.

SUMMARY OF THE INVENTION

The present invention is embodied in a planar-magnetic transducer. The transducer includes a magnet, a diaphragm and an electrically conductive trace. The magnet is formed from a continuous piece of magnetic material, and includes a first surface and a second surface opposite the first surface. The magnet includes at least one slot extending through the magnet from the first surface to the second surface. The diaphragm is mechanically coupled to a frame and disposed at a predetermined distance from the first surface of the magnet via the frame. The trace is coupled to the diaphragm. The trace is arranged in a predetermined pattern and at a predetermined position relative to the at least one slot of the magnet.

The present invention is also embodied in a method of manufacturing a planar-magnetic transducer. A magnet is formed from a continuous piece of magnetic material such that the magnet includes at least one slot. The magnet includes a first surface and a second surface opposite the first surface. The at least one slot extends through the magnet from the first surface to the second surface. A diaphragm is attached to a frame. The magnet is mechanically coupled to the frame such that the diaphragm is disposed at a predetermined distance from the first surface of the magnet via the frame. An electrically conductive trace is attached to the diaphragm, such that the trace is arranged in a predetermined pattern and at a predetermined position relative to the at least one slot of the magnet.

The present invention is also embodied in a stereo headphone. The stereo headphone includes a headband, a pair of speaker support frames that are each coupled to the headband and a pair of planar-magnetic loudspeakers. One of the planar-magnetic loudspeakers is mounted on each of the speaker support frames. Each planar-magnetic loudspeaker includes a magnet, a diaphragm and an electrically conductive trace. The magnet is formed from a continuous piece of magnetic material, and includes a first surface and a second surface opposite the first surface. The magnet includes at least one slot extending through the magnet from the first surface to the second surface. The diaphragm is mechanically coupled to a frame and disposed at a predetermined distance from the first surface of the magnet via the frame. The trace is coupled to the diaphragm. The trace is arranged in a predetermined pattern and at a predetermined position relative to the at least one slot of the magnet.

BRIEF DESCRIPTION OF THE DRAWINGS

The invention may be understood from the following detailed description when read in connection with the accompanying drawing. It is emphasized that, according to common practice, various features of the drawing may not be drawn to scale. On the contrary, the dimensions of the various features may be arbitrarily expanded or reduced for clarity. Moreover, in the drawing, common numerical references are used to represent like features. Included in the drawing are the following figures.

DETAILED DESCRIPTION OF THE INVENTION

Figure 1A:
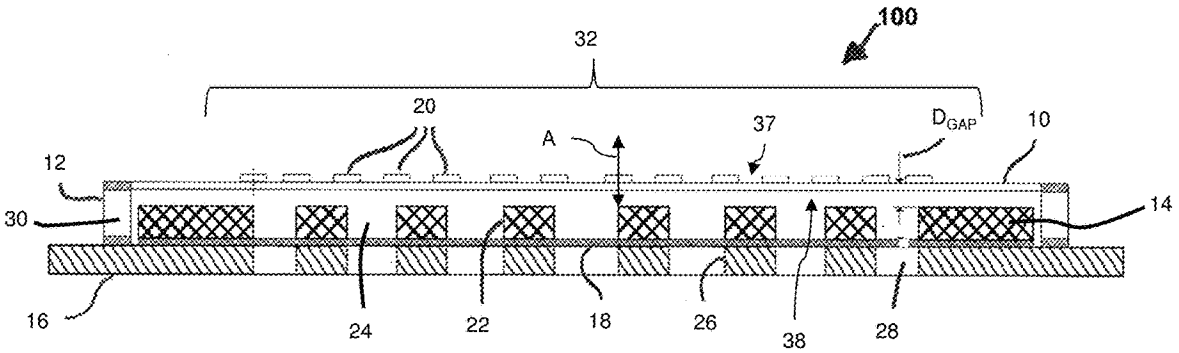
FIG. 1A is a cross-sectional view diagram of a one-piece magnet planar-magnetic transducer according to an example of the present invention.

Current planar-magnetic transducer designs use multiple magnets in order to displace the diaphragm and may experience issues with precise consistency of component placement across multiple transducers. Because of the variability in component placement, it may be difficult to provide consistent alignment of an electrically conductive trace pattern (i.e., a voice coil) to a magnetic field (generated by multiple magnets) over an entire length of the trace. Typically, an approximate placement of the conductive trace relative to the location of the magnetic field lines is used to manufacture current planar-magnetic transducers.

The inventors have determined that the placement of the electrically conductive trace relative to the magnetic field lines, as well as a width of the trace, have a significant effect on surface phase distortions of the thin film diaphragm (of planar-magnetic transducers). When a portion of the width of the trace is immersed within magnetic field lines of slightly differing vector and/or magnetic field strength relative to a portion of a nearby trace, a torqueing of the diaphragm occurs at various frequencies. The torqueing effect is described further below with respect to FIG. 4A.

A typical planar diaphragm thickness (for example, 1 mil (25.4 μm) thickness) may be effected less by a torque movement at various frequencies due to its higher stiffness (compared to thinner diaphragms). Thinner diaphragms (such as diaphragms having a thickness of about 0.5 mil or less) may also be desirable, for example for improved transducer response, efficiency and/or resonant characteristics. The use of a thinner diaphragm, however, may increase an audible effect of phase distortions due to any component misalignment. The phase distortions may be particularly noticeable in the near field, such as with headphone transducers.

Aspects of the present invention relate to planar-magnetic transducers including a one-piece magnet having a first surface and a second surface opposite the first surface, a thin (flexible) diaphragm and an electrically conductive trace mechanically coupled to the diaphragm. The diaphragm may be coupled to a frame and disposed at a predetermined distance from the first surface of the one-piece magnet via the frame. The one-piece magnet is formed from a single piece (i.e., a continuous piece) of magnetic material. The one-piece magnet includes at least one slot extending through the magnet from the first surface to the second surface. The trace may be arranged in a predetermined pattern and at a predetermined position relative to the at least one slot of the one-piece magnet. In one example, the one-piece magnet includes a plurality of parallel slots. The transducer may also include a baffle disposed on a second surface of the one-piece magnet. The baffle may include at least one slot arranged to correspond with the at least one slot of the magnet. In one example, the trace may be centered on an edge of each slot. At least one of a width of the trace and the predetermined position of the trace relative to the at least one slot may be selected to reduce torqueing of the diaphragm at one or more predetermined frequencies.

Because example planar-magnetic transducers of the present invention use a one-piece magnet having at least one slot, the slot(s) of the magnet may be formed in the magnetic material within consistent predetermined tolerances (e.g. with respect to sloth width, slot position, number of slots, etc.). Thus, the one-piece magnet may provide a magnetic field at a precise consistent location among multiple transducers. In addition, the field strength may be designed to be more evenly distributed across the magnet surface. An evenly distributed magnetic field allows for a more precise placement of the conductive trace to the magnetic field. Thus, transducers of the present invention may minimize phase distortions and provide repeatable manufacturability.

Figure 1B:
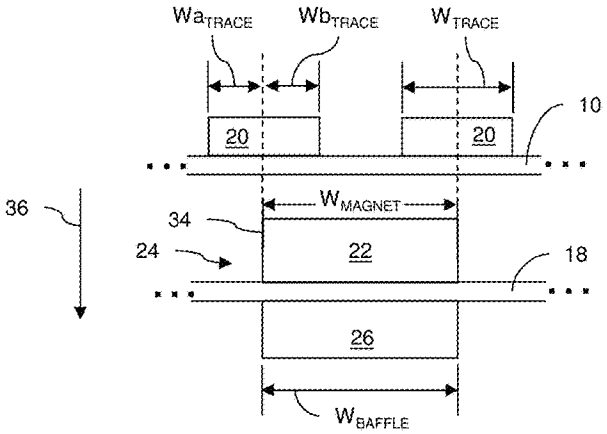
FIG. 1B is a cross-sectional view diagram of a portion of the planar-magnetic transducer shown in FIG. 1A, according to an example of the present invention.

Referring to FIGS. 1A and 1B, planar-magnetic transducer 100 (also referred to herein as transducer 100) is shown. In particular, FIG. 1A is a cross-sectional view diagram of transducer 100; and FIG. 1B is a cross-sectional view diagram of a portion of transducer 100.

Transducer 100 may include thin film diaphragm 10 having a predetermined tension mounted to rigid frame 12. Diaphragm 10 may be positioned at a predetermined distance $D_{gap}$ from one-piece magnet 14 via frame 12. Frame 12 and magnet 14 are each mechanically coupled to rigid front baffle 16. Acoustically transparent protective screen 18 may be disposed between magnet 14 and baffle 16. Electrically conductive trace 20 may be attached to diaphragm in a predetermined pattern (for example, as illustrated in FIG. 3).

Transducer 100 may include active area 32 in which diaphragm 10 is configured to be displaced (such as in a direction illustrated by double-headed arrow A). Magnet 14 may include a plurality of slots 24. Similarly, baffle 16 may include a plurality of slots 28. Slots 24 and slots 28 may provide for a transfer of acoustic energy through transducer 100 and protective screen 28. Thus, in active area 32, magnetic 14 includes a plurality of magnet portions 22 separated by slots 24. Similarly, baffle 16 includes a plurality of baffle portions 26 separated by slots 28. Slots 24 and slots 28 may be aligned, such that magnetic portions 22 and baffle portions 26 are also aligned.

Figure 3:
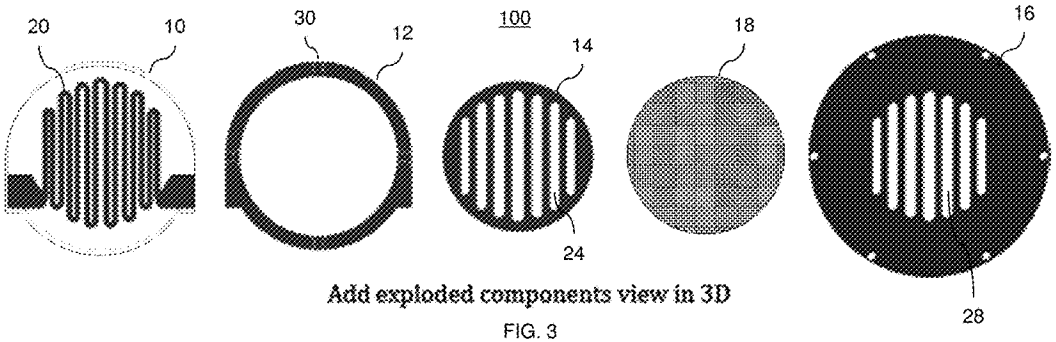
FIG. 3 is an exploded perspective view diagram of the planar-magnetic transducer shown in FIG. 1A, according to an example of the present invention.

As illustrated in FIG. 3, slots 24 and slots 28 are arranged in parallel and extend through respective magnet 14 and baffle 16 (e.g., along a thickness direction 36 as shown in FIG. 1B). Although FIGS. 1A and 3 illustrate plural parallel slots 24 and slots 28, magnet 14 and baffle 16 may each include one respective slot (aligned with each other for transfer of acoustic energy). Thus, in general, each of magnet 14 and baffle 16 may include at least one slot (i.e., respective slot 24 and slot 28) and at least two portions (i.e., respective magnet portions 22 and baffle portions 26).

Referring to FIG. 1B, a portion of transducer 100 in active area 32 is shown. FIG. 1B illustrates a relationship between a position of trace 20 and a width $W_{trace}$ of trace 20 relative to magnet portion 22 (and slot 24). Trace 20 includes a maximum width $W_{trace}$ (where $W_{trace}=Wa_{trace}+Wb_{trace}$). Trace 20 is positioned relative to vertical edge 34 of magnet portion 22 with width $Wa_{trace}$ positioned over slot 24 and width $Wb_{trace}$ positioned over magnet portion 22. In one example, trace 20 is substantially centered on vertical edge 34 of magnet portion 22 (such that $Wa_{trace}$ $Wb_{trace}$). Magnet portion 22 includes predetermined width $W_{magnet}$ and baffle portion 26 includes predetermined width $W_{baffle}$; As shown in FIG. 1B, the width $W_{magnet}$ magnet portion 22 may be substantially equal to the width $W_{baffle}$ of baffle port 26. As discussed further below with respect to FIGS. 4A and 4B, the position of trace 20 relative to slot 24 (and magnet portion 22) and the width $W_{trace}$ of trace 20 may be selected to reduce torqueing of diaphragm 10 at one or more predetermined frequencies.

Referring to FIG. 1A, in operation, an electrical signal is supplied to trace 20 (for example, by an audio amplifier electrically connected to trace 20). A variable voltage provided by the electrical signal generates an electromotive force via trace 20. The electromotive force may interact with the static magnetic field of magnet 14 (i.e., generated by magnet portions 22). Diaphragm 10 is displaced in accordance with variations in the electrical signal, as illustrated by double-headed arrow A. Thus, diaphragm 10 moves forward (i.e., towards magnet 14) and backwards (i.e., away from magnet 14) from its natural center (rested position) in response to the electrical signal, thereby creating acoustic output proportional to the electrical signal.

Diaphragm 10 may include any suitable thin pliable material capable of being displaced to produce an acoustic signal. Examples of diaphragm material include any suitable thin pliable polymer such as, without being limited to, polyester or polyimide. In one example, diaphragm 10 may be formed from a material such as polyimide having about 0.001 inch (1 mil) or less thickness with a heat tolerance in excess of about 400° F. Other examples of suitable diaphragm material may include polyimide films having about 0.25 mil or less thickness and polyester films having about 0.1 mil or less thickness. In general, it may be desirable to minimize a mass of diaphragm 10 (as well as a mass of trace 20) to lower distortion and improve efficiency.

In general, diaphragm 10 may be tensioned according to a predetermined tension to a planar configuration (i.e., a rest position) by rigid frame 12. Tensioning of diaphragm 10 may determine the frequency response and resonant characteristics of transducer 100. The predetermined tension may depend on the size, composition and/or overall mass of diaphragm 10 (with conductive trace 20 attached). In one example diaphragm 10 may be attached to frame 12 via an adhesive. In another example, diaphragm may be attached to frame 12 via clamping of diaphragm 10 to frame 12.

Rigid frame 12 may be formed from any suitable material capable of maintaining the tension of diaphragm 10 while separating diaphragm 10 from magnetic 14. Material of frame 12 includes, without being limited to, a polymer such as acrylic or nylon, having a rigidity such that frame 12 maintains an exact shape with or without the attached tensioned diaphragm 10. Frame 12 may include one or more vent openings 30 (also illustrated in FIG. 3), which may transfer acoustic pressure within transducer 100 into the ambient environment. Vents 30 may provide improved low frequency response and reduce pressure on diaphragm 10. Vent openings 30 may include beveled or rounded edges.

Magnet 14 may be formed from any ferromagnetic material suitable for forming a permanent magnetic field. Examples of magnetic material 14 include, without being limited to, ferrite, AlNiCo, and rare earth types such as neodymium. In an example, magnet 14 includes an energy rating of at least 34 Mega Gauss Oersteds (MGO), more preferably, at least 45 MGO.

In FIGS. 1A and 3, transducer 100 is illustrated as including a single one-piece magnet 14 (as a single magnet layer). In other examples, two or more one-piece magnets 14 may be formed (as multiple magnet layers), with each magnet 14 having slots 24. The two or more magnets 14 may be disposed on each other with respective slots 24 aligned. and disposed on each other. Two or more magnet layers may be formed to be equivalent to one magnet 14, such as for increased field strength.

Rigid baffle 16 may be formed from any suitable material capable of supporting the components of transducer 100. In general, baffle 16 may be used as a support and mounting structure for the remaining components of transducer 100. Examples of baffle 16 materials may include, without being limited to, that of high relative permeability materials (e.g., materials of permeability greater than or equal to about 100 $\mu/\mu_0$), such as steel. In general, baffle 16 may be formed with a high enough rigidity so as not to flex, expand or contract thereby potentially causes a misalignment or breakage of the adhered components.

In some examples, baffle 16 is formed from a ferromagnetic material, and may also be used to concentrate the magnetic field. For example, baffle 16 may concentrate the magnetic field in a location on diaphragm side of magnet 14, close to the surface of magnet 14. The crest of the magnetic field lines may be generated significantly parallel to vertical edge 34 of magnet portions 22, by drawing the field down through slots 24 and 28 toward baffle portions 26. This may allow optimum positioning of conductive trace 20 within the field crest and as near as possible to the magnet surface to maximize efficiency.

Screen 18 may be formed from any suitable acoustically transparent material capable of acting as a protective screen or mesh, to keep out particulate or other foreign objects, and may act as an electrostatic shield. Examples of material of screen 18 may include, without being limited to, plastic or stainless steel mesh.

Conductive trace 20 is formed from any suitable electrically conductive material such as, without being limited to, aluminum, copper, silver, gold, or carbon. Conductive trace 20 typically dissipates heat with normal use. It is desirable that the diaphragm material maintains the predetermined tension with minimal effect due to potentially higher temperatures. The trace material and method used to attach trace 20 to diaphragm 10 desirably has a high enough heat tolerance so as not to fail under peak input power. Trace 20 may be attached to diaphragm 10, for example, via an adhesive layer or via vapor deposition.

For example, a thickness of conductor trace 20 may depend on the power limits of transducer 100. In one example, the trace thickness may be about 0.5 mil for a loudspeaker with higher power handling, and in another example, may be less than about 0.05 mil thick for lower power dissipation (such as within a headphone). In general, trace 20 width $W_{trace}$ is minimized and may depend on a target transducer impedance. In one example, for transducer 100 shown in FIG. 5, the width $W_{trace}$ of trace 20 trace width is about. 0.1" (100 mil). In general, the width (and the position) of trace 20 may be selected (as described further with respect to FIG. 4B), to reduce torqueing of diaphragm 10 at one or more predetermined frequencies. The width $W_{trace}$ may be minimized to stay within the crest of the magnetic lines (such as magnetic lines 44 shown in FIG. 4B). The trace may also be selected in view of any impedance and power specifications, and to minimize the mass of trace 20.

Distance $D_{gap}$ between diaphragm 10 and magnet 14 may be determined by the maximum excursion of diaphragm 10, such that diaphragm 10 is as close as possible to the surface of magnet 14 to maximize an efficiency of transducer 100 while avoiding physical contact with magnet 14 under normal operating conditions. A thickness of frame 12 and any corresponding adhesive layers may determine distance $D_{gap}$. A composition of diaphragm 10, trace 20, adhesives, frame 12 and/or baffle 16 may be selected to maintain the predetermined tension and structural integrity of transducer 100 (for example, to minimize sonic degradation and/or long term failure of transducer 100).

Figure 2A:
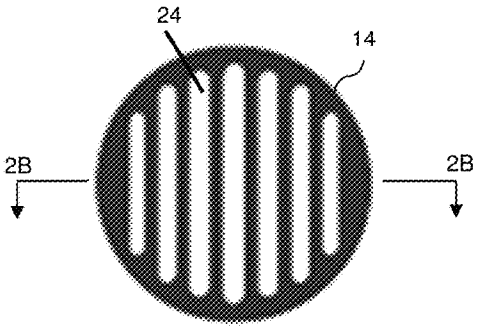
FIG. 2A is an overhead view diagram of the one-piece magnet shown in FIG. 1A, according to an example of the present invention.
Figure 2B:
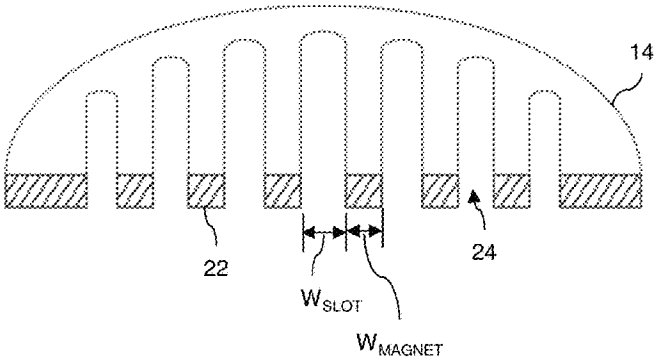
FIG. 2B is a partially cross-sectional perspective view diagram of the one-piece magnet shown in FIG. 2A along lines 2B-2B.

Referring to FIGS. 2A and 2B, magnet 14 of transducer 100 (FIG. 1A) is shown. In particular, FIG. 2A is an overhead view diagram of magnet 14; and FIG. 2B is a partially cross-sectional perspective view diagram of magnet 14 along lines 2B-2B.

FIGS. 2A and 2B illustrate an example spacing of magnetic portions 22 relative to slots 24. In one example, each magnet portion 22 may have a same width ($W_{magnet}$). In another example, different magnet portions 22 may have different widths. In another example, each slot 24 may have a same width ($W_{slot}$). In another example, different slots 24 may have different widths. In other examples, both different magnet portions 22 and different slots 24 and may have different widths.

In a further example, slot width $W_{slot}$ may be largest at a center of magnet 14 and decrease as slots 24 progress towards a periphery of magnet 14 (i.e., along the horizontal direction). As described further below, this configuration may allow for less acoustic impediment of magnet 14 on the motion of diaphragm 10.

As shown in FIG. 2A, to produce acoustic output, the front to back motion of diaphragm 10 (towards and away from magnet 14 along double-headed arrow A) generates a planar acoustic wave emanating perpendicularly from surface 37 (away from magnet 14) and surface 38 (towards magnet 14). Any nearby structure (such as the surface of magnet 14 or other structures with significant surface area relative to diaphragm 10) may offer resistance to diaphragm 10, by reflecting planar acoustic waves back to diaphragm 10. This resistance by nearby structures may restrict the motion of diaphragm 10, particularly with respect to bass frequencies, such as less than about 100 Hz.

Diaphragm 10 has no magnet or other acoustically restrictive structure adjacent to surface 37, such that a planar acoustic wave has space to dissipate away from diaphragm 10. Surface 38 of diaphragm 10, however, may experience resistance to motion due to the parallel surface area of magnet 14. In other words, the surface area of magnet 14 may restrict diaphragm motion at lower frequencies, while the open area provided by slots 24 allow for greater freedom of motion.

In addition, diaphragm 10 may be concentrically attached to a tensioning ring or frame 12. Thus, the displacement of diaphragm 10 may be greatest in its center and lessen towards an outer circumference of diaphragm 10.

Transducer efficiency may be determined in part by the amount of active conductive trace 20 on diaphragm 10. In transducer 100, conductive trace 20 may be formed in a pattern to follow slots 24 of magnet 14 (as shown in FIG. 3). A wider slot 24, therefore, produces a wider trace pattern with less of trace 20 per surface area, and less driving force.

Given the above conditions, by forming magnet 14 such that center slot 24 has a largest width, the center slot provides the largest open area on magnet 14 and, thus, provides minimal acoustic resistance to the maximal area of excursion of diaphragm 10. By forming the outer slots 24 with increasingly narrower width (away from the magnet center towards the magnet periphery) this provides an increased conductive trace 20 per area (towards the periphery). The increased amount of trace per surface area produces a more active driven area (to counter the mechanically restricted area of the diaphragm towards its outer circumference), and provides a better alignment with its center for greater linearity.

Although slots 24 are illustrated in FIG. 2B as having square edges, slots 24 may also be formed with beveled or rounded edges. The use of beveled or rounded edges may reduce acoustic noise due to air flow turbulence through the slots.

Referring next to FIG. 3, an exploded perspective view diagram of transducer 100 is shown. FIG. 3 illustrates an example process of forming transducer 100.

Magnetic material may be formed into any suitable shape (such as a circular disk) and one or more slots may be formed in the magnetic material, to produce one-piece magnet 14. As one example, the magnetic material may be placed in a mold having a desired shape and slots 24 of predetermined width, to produce one-piece magnet 14. As another example, machining operations could be made on the material (prior to magnetization) to form slots. Thus, magnet 14 may be formed from a continuous (i.e., single) piece of magnetic material by forming at least one slot 24 in the magnetic material. Baffle 16 may be formed in a similar manner with one or more slots 28 corresponding to slot(s) 24 of magnet 14.

Frame 12 may be formed having suitable dimensions for allowing displacement of diaphragm 10 while preventing diaphragm 10 from contacting magnet 14. One or more vent holes 30 may, optionally, be formed in frame 12.

Diaphragm 10 may be mounted on frame 12 via any suitable dispensable liquid adhesive such as epoxy or a precut double-sided adhesive, such that diaphragm 10 maintains a predetermined tension (in a rest position). Magnet 14 may be mounted on baffle 16 via an adhesive material, such that slots 24 of magnet 14 are aligned with slots 28 of baffle 16. Protective screen 18 may, optionally, be adhered between magnet 14 and baffle 16.

Conductive trace 20 may be formed in a predetermined pattern corresponding to slots 24 of magnet 14. Conductive trace 20 may be mounted on diaphragm 10, for example, via an adhesive material or by vapor deposition. Frame 12 may be mounted on baffle 16 via an adhesive material, thus forming transducer 100.

Electrical connection may be made to either side of trace 20 via an electrical conduit (not shown). The electrical conduit may be mechanically connected to transducer 100, such as via spring metal clips (not shown). The leads may connect to a detachable interface suitable for connection to an audio amplifier.

FIGS. 1A, 2A and 3 illustrate components of transducer 100 having a generally circular shape. It is understood that transducer 100 may include any suitable symmetrical or asymmetrical shape, including any regular or irregular polygon shape.

Figure 4A:
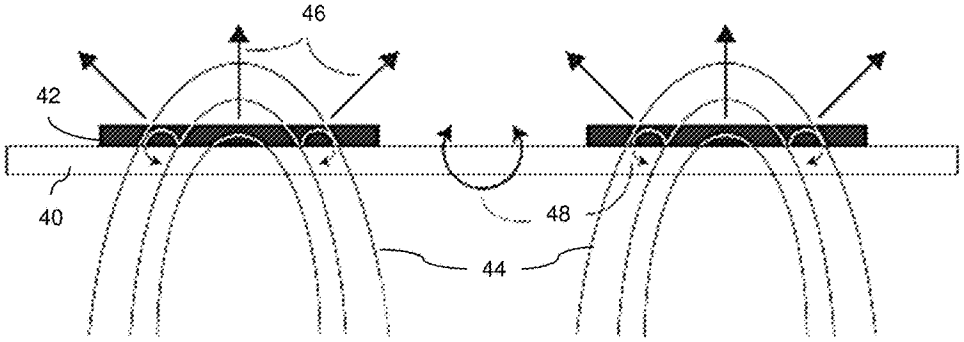
FIGS. 4A and 4B are cross-sectional view diagrams of a thin film diaphragm and conductive trace, illustrating electromotive forces on the diaphragm due to electromagnetic forces on the conductive trace, without optimization of the trace and with optimization of the trace, respectively, according to examples of the present invention.
Figure 4B:
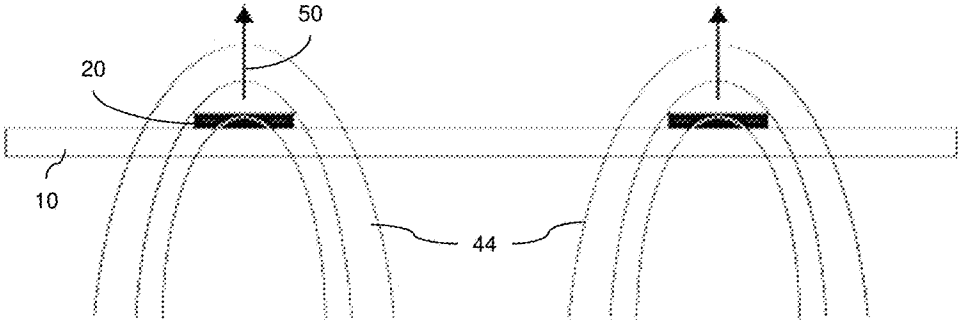

Referring next to FIGS. 4A and 4B, electromotive force (EMF) on a diaphragm due to electromagnetic force on a conductive trace is described. In particular, FIG. 4A illustrates an example of EMF 46 on diaphragm 40 due to electromagnetic forces 44 on trace 42 whose width and/or placement are not optimized; and FIG. 4B illustrates EMF 50 on diaphragm 10 due to electromagnetic forces 44 when trace 20 is optimized for position and/or width.

FIGS. 4A and 4B show exemplary cross sections of respective diaphragms (40, 10) and traces (42, 20). FIGS. 4A and 4B also illustrate the respective EMF (46, 50) generated as per Fleming's Rules given an electrical current through the respective trace (42, 20), and variations in the magnetic lines of force 44 at different traverse locations within the width of each conductive trace (42, 20).

In FIG. 4A, conductive trace 42 has a width and/or a placement that has not been optimized (relative to magnetic field lines 44). Magnetic field lines 44 intersect trace 42 at different vectors, setting up torque movements 48 on a surface of diaphragm 40. Flexing of diaphragm 40 creates small localized phase distortions at various frequencies or a modulation of fundamental frequencies of diaphragm 40. Subjectively, such distortions (particularly in the near-field), may be heard as a blurring together of notes or instruments, or as an dulling of or reduction in high frequency information.

FIG. 4B illustrates an optimized design (such as shown by transducer 100 in FIG. 1A). Because a width and/or a position of trace 20 is optimized (relative to magnetic field lines 44 from magnet portions 22), the magnetic field crest runs nearly parallel to and through trace 20. Thus, EMF 50 is primarily perpendicular to trace 20. This produces a linear forward and backward planar diaphragm motion across the entire surface of diaphragm 10 in response to an applied AC current.

Figure 5:
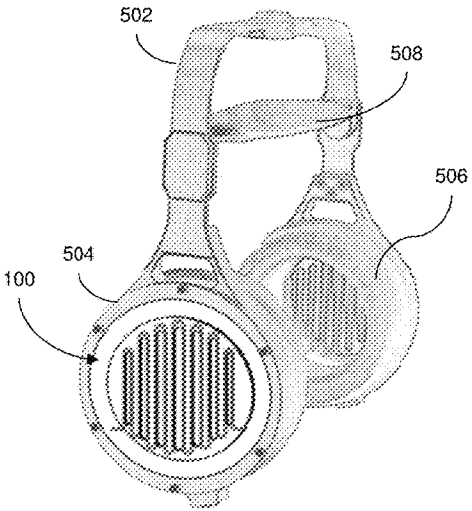
FIG. 5 is a perspective view diagram of a pair of headphones including the planar-magnetic transducer shown in FIG. 3, according to an example of the present invention.

Referring to FIG. 5, a perspective view diagram of exemplary stereo headphone 500 is shown. Stereo headphone 500 includes transducer 100 used as a speaker in each headphone channel, with front baffle 16 positioned to face a wearer's ear. Stereo headphone 500 illustrates an example of transducer 100 used as a near-field transducer (also referred to herein as a headphone transducer).

Stereo headphone 500 includes headband 502 and a pair of speaker support frames 504. Headband 500 may be adjustable, to fit a variety of different users. Stereo headphone 500 may also include support structure 508 connected to headband 502. Support structure 508 may aid in adjustment of headband 502 and/or aid in maintaining placement of speaker support frames 504 against a wearer's head. Transducer 100 is mounted on each speaker support frame 504. Sound insulation ring 506 (also referred to as ear pad 506) is mounted on each speaker support frame 504 and is coupled to transducer 100.

As discussed above, frame 12 of transducer may include one or more vents 30, such as the four vents shown in FIG. 3. Each headphone may include an ear pad 506 mounted to front baffle 16 that rests against the side of the wearer's head, forming an acoustic seal between the wearer's head and diaphragm 10. Vent openings 30 may reduce the amount of acoustic seal in a vicinity of vents 30. Vent opening 30 may provide improved low frequency response (for example, by about +3 dB below 28 Hz) and may help prevent potential damage from excessive pressure on diaphragm 10 in normal use (such as in fitting headphones 500 to the wearer's head).

Various factors of stereo headphones 500 may contribute to an acoustic damping and impulse response of diaphragm 10, and create a near-field acoustic space with the wearer's head. Example factors include, without being limited to, a surface area of diaphragm 10, and mass of diaphragm 10, a mass of trace 20, venting by vent openings 30, dimensions (e.g., width and/or depth) of magnet slots 24, dimensions of baffle slots 28, the location of transducer 100 relative to the wearer's ear, the ear pad dimensions, the ear pad material(s), an amount of acoustic seal of transducer 100 to the wearer's head, and construction of the enclosure of each headphone (such as whether surface 37 of diaphragm 10 is sealed or open to the ambient environment). Varying any of these parameters may provide fine tuning of the response of transducer 100 as a headphone transducer.

Referring next to FIGS. 6A, 6B, 7 and 8, example transducer response characteristics are shown for an example configuration of transducer 100. In FIGS. 6A-8, the measurements were made with an example transducer 100 assembled with components as shown in FIG. 3, exempt of screen 18. The example transducer 100 includes circular diaphragm 10 with an active region 66 mm in diameter and base material 0.25 mil thick PET with attached trace 20 of aluminum, attached to a rigid frame 12 of acrylic. Transducer 100 includes magnet 14 of neodymium with strength 48 MGO and seven slots 24 with varying width (as shown in FIG. 5), with baffle 16 of steel with slots 28 arranged to correspond with slots 24 of magnet 14. Transducer 100 is mounted to a speaker support frame 504 as in FIG. 5, with ear pad 506, and coupled to a dummy head with enclosed ear microphone.

Figure 6A:
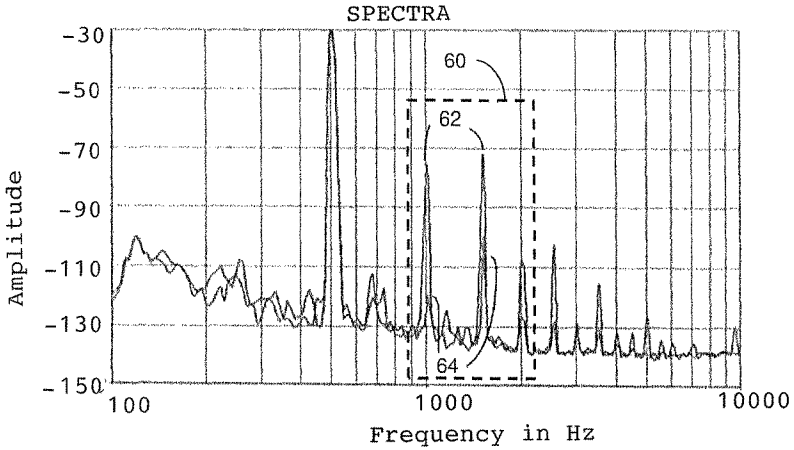
FIG. 6A is a graph of example spectral responses of a planar-magnetic transducer according to the present invention and a conventional planar-magnetic transducer.
Figure 6B:
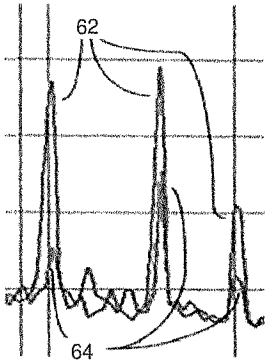
FIG. 6B is a graph of example spectral responses for an inset portion of the graph shown in FIG. 6A.

FIGS. 6A and 6B illustrate an example spectral response 62 of transducer 100. In particular, FIG. 6A is a graph of example spectral response 62 of transducer 100; and FIG. 6B illustrates inset portion 60 of FIG. 6A. The harmonic spectra 64 of a typical (conventional) planar magnetic driver is also shown in FIGS. 6A and 6B. FIG. 6A illustrates the spectra (62, 64) from 100 Hz to 10 KHz. In the example, transducer 100 is driven with a fundamental input frequency of 500 Hz. Harmonic spectra 64 of the typical driver has significantly less second or even order distortion. Both even and odd harmonic distortion may improve the enjoyment of musical reproduction, in part by enhancing the natural decay characteristics typically altered in the processes of digital recording, mastering and playback.

Figure 7:
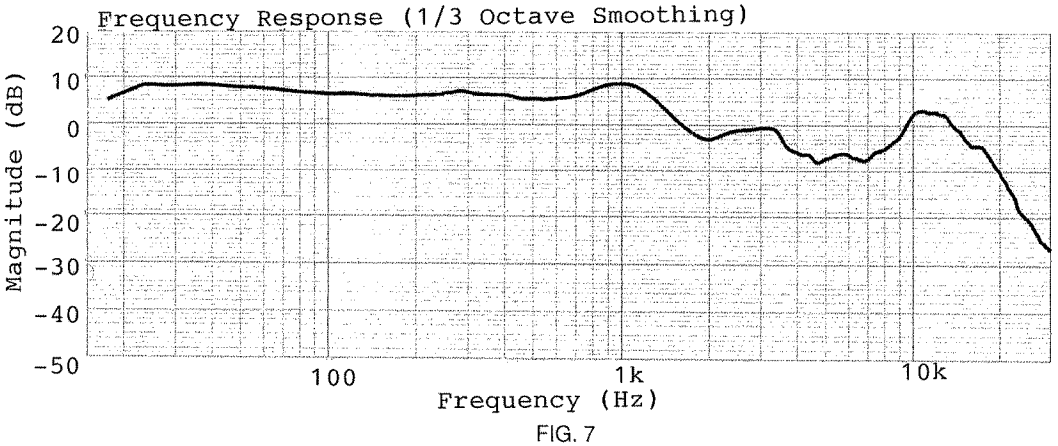
FIG. 7 is a graph of an example frequency response of a planar-magnetic transducer according to the present invention.
Figure 8:
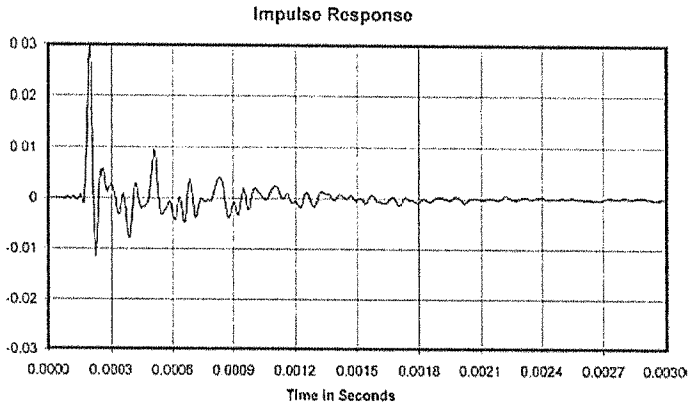
FIG. 8 is a graph of an example impulse response of a planar-magnetic transducer according to the present invention.

FIGS. 7 and 8, illustrate graphs of example frequency response and impulse response curves of transducer 100, respectively. In FIGS. 7 and 8, transducer 100 is used as a near field as a headphone speaker, positioned on a dummy head using an enclosed ear microphone for capturing the frequency response and impulse response measurements.

Although the invention is illustrated and described herein with reference to specific embodiments, the invention is not intended to be limited to the details shown. Rather, various modifications may be made and the details within the scope and range of equivalence of the claims and without departing from the invention.

What is claimed:

1. A plan magnetic transducer comprising:

a magnet formed from a continuous piece of magnetic material, the magnet including a first surface and a second surface opposite the first surface, the magnet including at least one slot extending through the magnet from the first surface to the second surface;

a diaphragm mechanically coupled to a frame and disposed at a predetermined distance from the first surface of the magnet via the frame; and an electrically conductive trace coupled to the diaphragm, the trace comprising a continuous layer of conductive material centered on an edge of the at least one slot.

2. The planar-magnetic transducer according to claim 1, wherein a width of the trace is selected to reduce torqueing of the diaphragm at one or more predetermined frequencies.

3. The planar-magnetic transducer according to claim 1, further comprising a baffle disposed on the second surface of the magnet, the baffle including at least one slot arranged to correspond with the at least one slot of the magnet.

4. The planar-magnetic transducer according, to claim 3, further comprising an acoustically transparent screen disposed between the magnet and the baffle.

5. The planar-magnetic transducer according to claim 1, wherein the frame includes at least one vent opening.

6. The planar-magnetic transducer according to claim 1, wherein the at least one slot includes a plurality of parallel slots extending through the magnet.

7. The planar-magnetic transducer according to claim 6, wherein each of the plurality of parallel slots has a same width.

8. The planar-magnetic transducer according to claim 6, wherein each of the plurality of parallel slots is bounded on all sides by the continuous piece of magnetic material.

9. The planar-magnetic transducer according to claim 1, wherein the magnet includes at least two magnet portions separated by the at least one slot, each magnet portion having a same width.

10. The planar-magnetic transducer according to claim 1, wherein the magnet includes at least two magnet portions separated by the at least one slot, at least one of the at least two magnet portions having a different width than others of the at least two magnet portions.

11. The planar-magnetic transducer according to claim 1, wherein the planer-magnetic transducer is configured as a headphone loudspeaker.

12. The planar-magnetic transducer according to claim 1, wherein the magnet includes at least two magnets coupled to each other, each magnet including the at least one slot.

13. The planar-magnetic transducer according to claim 1, wherein the magnetic material includes at least one of a rare earth element, AlNiCo, ferrite or neodymium.

14. The planar-magnetic transducer according to claim 1, wherein the at least one slot is bounded on all sides by the continuous piece of magnetic material.

15. A planar-magnetic transducer comprising:

a magnet formed from a continuous piece of magnetic material, the magnet including a first surface and a second surface opposite the first surface, the magnet including a plurality of parallel slots extending through the magnet from the first surface to the second surface, each of the plurality of parallel slots having a width and at least one slot of the plurality of slots having a different width than other slots of the plurality of slots;

a diaphragm mechanically coupled to a frame and disposed at a predetermined distance from the first surface of the magnet via the frame; and an electrically conductive trace coupled to the diaphragm, the trace being centered on an edge of the at least one slot.

16. A method of manufacturing a planar-magnetic transducer comprising:

forming a magnet from a continuous piece of magnetic material such that the magnet includes at least one slot, the magnet including a first surface and a second surface opposite the first surface, the at least one slot extending through the magnet from the first surface to the second surface;

attaching a diaphragm to a frame;

mechanically coupling the magnet to the frame such that the diaphragm is disposed at a predetermined distance from the first surface of the magnet via the frame; and attaching an electrically conductive trace comprising a continuous layer of conductive material to the diaphragm, such that the continuous layer of conductive material is centered on an edge of the at least one slot.

17. The method according to, claim 16, the method further comprising:

forming a baffle having at least one slot; and mechanically coupling the baffle to the second surface of the magnet such that the at least one slot of the baffle is aligned with the at least one t of the magnet.

18. The method according to claim 17, the method further comprising:

disposing an acoustically transparent screen between the magnet and the baffle.

19. The method according to claim 16, the method further comprising:

selecting a width of the trace to reduce torqueing of the diaphragm at one or more predetermined frequencies.

20. The method according to claim 16, wherein the at least one slot includes a plurality of parallel slots extending through the magnet.

21. The method according to claim 20, wherein each of the plurality of parallel slots has a width and at least one slot of the plurality of slots is formed with a different width than other slots of the plurality of slots.

22. The method according to claim 20, wherein each of the plurality of parallel slots is formed with a same width.

23. The method according to claim 20, wherein each of the, plurality of parallel slots is bounded on all sides by the continuous piece of magnetic material.

24. The method according to claim 16, wherein the planar-magnetic transducer is configured as a headphone speaker and the method further comprises:

mounting the headphone speaker to one of each of a pair of speaker support frames of a stereo headphone.

25. The method according to claim 16, wherein the at least one slot is bounded on all sides by the continuous piece of magnetic material.

26. A stereo headphone comprising:

a headband;

a pair of speaker support frames, each speaker support frame coupled o the headband; and a pair of planar-magnetic loudspeakers, one of the planar-magnetic loudspeakers mounted on, each of the speaker support frames;

wherein each planar-magnetic loudspeaker include:

a magnet formed from a continuous piece of magnetic material, the magnet including a first surface and a second surface opposite the first surface, the magnet including at least one slot extending through the magnet from the first surface to the second surface, a diaphragm mechanically coupled to a frame and disposed at a predetermined distance from the first surface of the magnet via the frame, and an electrically conductive trace coupled to the diaphragm, the trace comprising a continuous layer of conductive material centered on an edge of the at least one slot.

27. The stereo headphone of claim 26, wherein a width of the trace is selected to reduce torqueing of the diaphragm at one or more predetermined frequencies.

28. The stereo headphone of claim 26, wherein each planar-magnetic loudspeaker further includes a baffle disposed on the second surface of the magnet, the baffle including at least one slot arranged to correspond with the at least one slot of the magnet.

29. The stereo headphone of claim 26, wherein, in each planar-magnetic loudspeaker, the frame includes at least one vent opening.

30. The stereo headphone of claim 26, wherein each speaker support frame includes a sound insulation ring coupled to one of the planar-magnetic loudspeakers.

31. The stereo headphone of claim 26, wherein each planar-magnetic loudspeaker further includes an acoustically transparent screen disposed between the magnet and the baffle.

32. The stereo headphone of claim 26, wherein the at least one slot is bounded on all sides by the continuous piece of magnetic material.

33. The stereo headphone of claim 32, wherein the at least one slot includes a plurality of parallel slots extending through the magnet, the plurality of parallel slots bounded on all sides by the continuous piece of magnetic material.

* * * * *